United States Patent [19]

Schaller

[11] 3,982,462

[45] Sept. 28, 1976

[54] STRINGED INSTRUMENT MACHINE HEAD

[76] Inventor: Helmut F. K. Schaller, Kuckucksweg 16, 8501 Feucht, Germany

[22] Filed: Dec. 2, 1975

[21] Appl. No.: 637,105

[52] U.S. Cl. ..... 84/306

[51] Int. Cl.[2] ..... G10D 3/14

[58] Field of Search ..... 84/200, 204, 304, 306

[56] References Cited

UNITED STATES PATENTS

| | | | |
|---|---|---|---|
| 726,706 | 4/1903 | Lang | 84/306 |
| 1,083,736 | 1/1914 | Glaesel | 84/306 |
| 3,496,825 | 2/1970 | Wustl | 84/306 |

*Primary Examiner*—Lawrence R. Franklin

*Attorney, Agent, or Firm*—McCormick, Paulding & Huber

[57] ABSTRACT

A machine head for a guitar or a similar stringed musical instrument has a unique construction reducing backlash and other undesirable looseness between its parts and allowing its base member to be made as a one-piece sheet metal part.

8 Claims, 8 Drawing Figures

STRINGED INSTRUMENT MACHINE HEAD

BACKGROUND OF THE INVENTION

This invention relates to stringed musical instruments, and deals more particularly with a machine head for use in attaching the outer end of a string to an instrument and in tensioning the string to tune it to its desired pitch.

The general object of the invention is to provide a stringed instrument machine head which is relatively economical and easy to manufacture and which is smooth and reliable in operation.

A more particular object of this invention is to provide a machine head for a stringed musical instrument which includes a base member which may be made as a sheet metal part, wherein the worm and worm gear are held in perfect meshing relationship with one another and wherein the worm shaft and string post are held accurately in place relative to the base member to achieve smooth and unbinding operation of the head with little or no backlash or other loose movement between the parts.

A still further object of the invention is to provide a machine head for a stringed instrument of the foregoing character which may be made as either a single or a multiple string unit with the base member in either case being a single sheet metal part.

Other objects of the invention will become apparent from the following description and from the drawings forming a part hereof.

In the description and in the claims forming a part hereof, the terms "horizontal," "vertical," "upper," "lower" and the like are to be taken with the machine head oriented as in FIGS. 4 to 6.

SUMMARY OF THE INVENTION

Figures 1, 2, 3, 4, 5, 6, 7, 8:
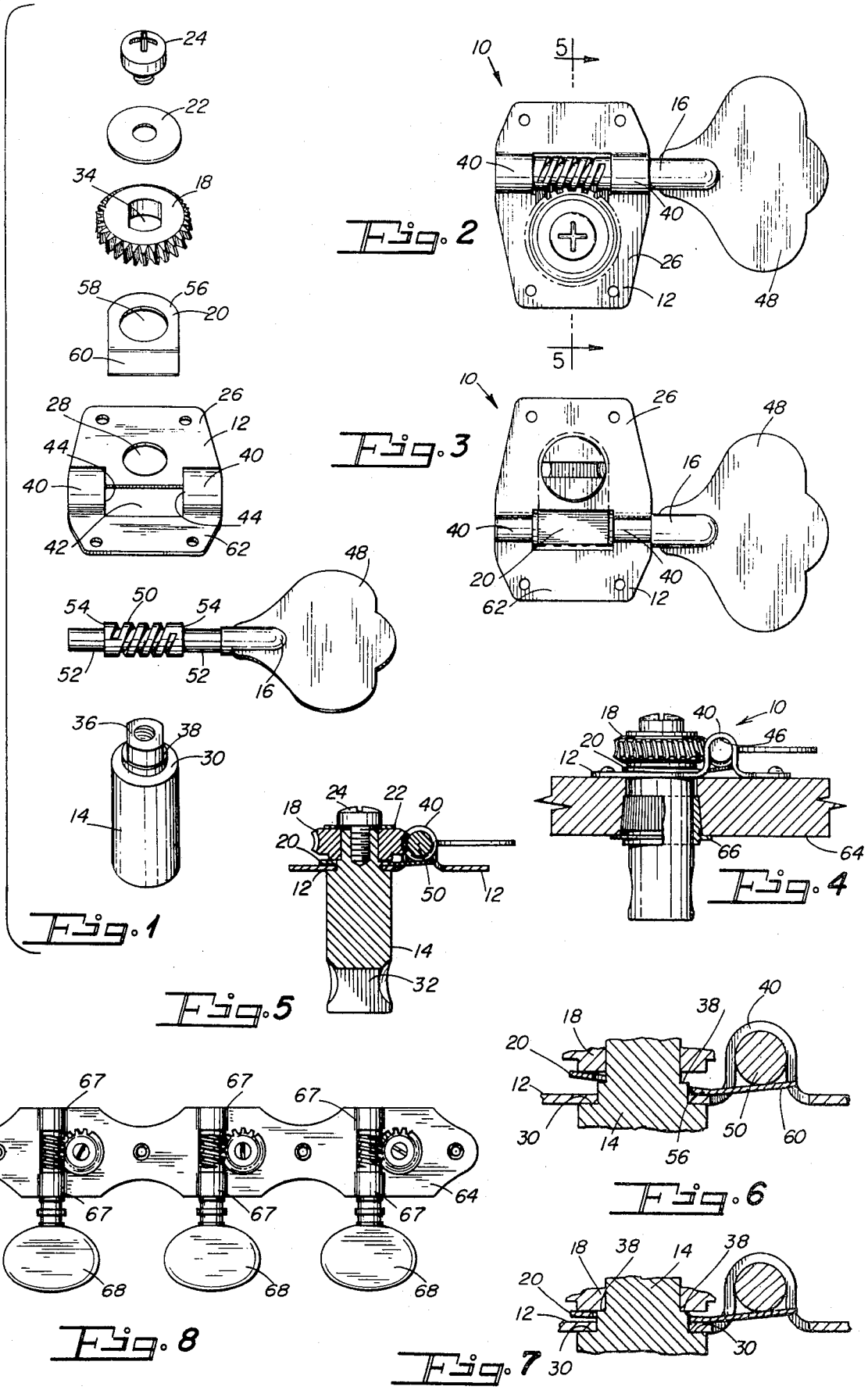
FIG. 1 is an exploded view showing the parts making up a single string machine head embodying this invention.
FIG. 2 is a top plan view of a completely assembled machine head comprised of the parts of FIG. 1.
FIG. 3 is a bottom view of the machine head of FIG. 2.
FIG. 4 is a side elevational view of the machine head of FIG. 2 with this view also showing the machine head mounted to an associated portion of an instrument, the view being taken looking toward the left-hand end of the machine head as viewed in FIG. 2.
FIG. 5 is a vertical sectional view taken on the line 5—5 of FIG. 2.
FIG. 6 is a portion of FIG. 5 drawn on an enlarged scale and with the worm gear being shown moved upwardly from its assembled or FIG. 5 position to show the leaf spring in its undeflected state.
FIG. 7 is a view similar to FIG. 6 except for the worm gear being shown in its fully assembled position as in FIG. 5.
FIG. 8 is a plan view of a multiple string machine head comprising an alternative embodiment of this invention.

The invention resides in a machine head for a guitar or similar stringed instrument consisting of a base member, a string post carrying a worm gear, and a worm shaft having a worm meshing with the worm gear and a thumb turn for manually rotating the shaft. The string post passes through and is journalled in an opening in the base member and has an upwardly facing shoulder engageable with the bottom surface of the base member. The worm shaft is journalled in axially spaced, downwardly facing, inverted U-shaped bearing surfaces on the base member. A leaf spring is received on the string post between the upper surface of the base member and the bottom surface of the worm gear and includes a portion which also engages the bottom of the worm. The undeflected shape of the leaf spring is such that in assembly with the other parts of the machine head, it resiliently urges the worm and worm gear upwardly relative to the base member to hold the string shaft and the worm shaft in desired positions relative to the base member. The invention further resides in the base member being a sheet metal part wherein the downwardly facing inverted U-shaped bearing surfaces for the worm shaft are provided by two axially aligned U-shaped bends in the sheet metal with the plate having a slot between the two bends for receiving the worm and with the worm shaft having radial shoulders at opposite ends of the worm engaging the end edges of the bends to prevent axial play of the shaft.

DETAILED DESCRIPTION OF THE PREFERRED EMBODIMENTS

Turning to the drawings and first referring to FIGS. 1 to 7, a single string machine head embodying the invention is indicated generally at 10. Its parts consist solely of a base member 12, a string post 14, a worm shaft 16, a worm gear 18, a leaf spring 20, a washer 22 and a screw 24. The base member 12 may take various different forms without departing from the broader aspects of the invention, but in the preferred and illustrated case, it is a sheet metal piece generally in the form of a flat plate which may be made by common sheet metal forming procedures.

The base member 12 includes a first flat horizontal portion 26 having a circular opening 28 through which the string post 14 passes. Adjacent the bottom surface of the base member 12, the post has an upwardly facing radial shoulder 30 engageable with the base member to limit upward movement of the post. The post 14, below the base member 12, includes a lower portion which is generally cylindrical in shape and which is slotted as at 32 to aid in attaching a string to the post and to cause the string to be wound around the exterior surface thereof as the post is rotated. The upper portion of the post 14, which extends above the base member 12, has the worm gear 18 fixed thereto by the screw 24 and washer 22, the worm having a non-circular opening 34 and the post 14 having a conforming non-circular portion 36 for receiving the worm gear. Adjacent the lower end of the portion 36, the post 14 includes a second upwardly facing radial shoulder 38 which is engageable with the bottom end surface of the worm 18 to axially position the worm relative to the post.

Adjacent the flat portion 26, the base member includes two inverted U-shaped bends 40, 40 which project upwardly from the portion 26 and which are spaced from one another along a common horizontal axis. Between the two bends 40, 40 the base member includes a slot 42, and the two bends provide two end edge surfaces 44, 44, seen best in FIG. 1, facing one another and located in parallel vertical planes. The two bends further define two corresponding inverted U-shaped downwardly facing bearing surfaces, one of which is indicated at 46 in FIG. 4.

The worm shaft 16 includes a thumb turn 48 for manually rotating it, an axially extending worm 50 and, on opposite sides of the worm, two axially extending portions 52, 52 providing generally cylindrical bearing surfaces. The worm shaft is journalled to the base member 12 by having the bearing portions 52, 52 thereof received in the U-shaped bends 40, 40 of the base member, the worm 50 being located in the space between the bends. At the opposite ends of the worm 50 are two radial shoulders 54, 54 which engage the end surfaces 44, 44 of the bends to prevent axial movement of the shaft relative to the base member.

The worm shaft 16 is held in the bends 40, 40 by the leaf spring 20. In particular, the spring 20 has a first portion 56 which is located between the top surface of the base plate 12 and the bottom surface of the worm 18 and which includes a circular opening 58 though which the upper portion of the string post 14 passes. The spring also includes another portion 60 which extends into the slot 42 of the base plate and engages the bottom of the worm 50.

As shown best in FIGS. 6 and 7, the spring 20 has such a natural or undeflected shape that in the assembled unit it is held in a deflected state between the base plate and the worm and worm gear so as to bias both the worm gear and the worm upwardly relative to the plate, thereby urging the string post 14 upwardly to seat its shoulder 30 firmly against the bottom surface of the plate and to urge the worm shaft upwardly to firmly seat its bearing portions 52, 52 firmly against the bight portions of the U-shaped bearing surfaces defined by the bends 40, 40. In FIG. 6, the spring 20 is shown in its undeflected state which it has prior to the worm 80 being moved to its fully assembled position on the shaft 14 by tightening of the screw 24. FIG. 7 shows the position assumed by the worm 18 after the screw 24 is fully tightened and the worm moved to its fully assembled position at which its lower end surface engages the shoulder 38. In connection with FIG. 7, it should also be noted that the spacing between the shoulder 30 and the shoulder 38 is equal to or only very slightly greater than the combined thicknesses of the base plate 12 and the spring 20. That is, the shoulder spacing is such that the base plate and leaf spring are not clamped between the worm gear and the post shoulder 30 so as to impair or resist rotation of the post, but on the other hand the spacing is not great enough to provide a significant amount of looseness enabling the post to possibly wobble or tilt relative to the base plate. Preferably, the spacing between the shoulders 30 and 38 is no more than 0.005 inch greater than the combined thicknesses of the base plate and leaf spring. It should also be noted, as seen in FIG. 5, that the upper end of the string post 14 is slightly spaced from the bottom of the washer 22 so that the washer will not bottom against it and will instead firmly hold the bottom surface of the worm gear 18 against the shoulder 38.

The worm 50, of course, meshes with the worm gear 18 so that when the worm shaft 16 is rotated, by use of the thumb turn 48, a resultant rotation of the string post 14 is obtained. Further, the construction is such that the U-shaped bends 40, 40 and the post mounting hole 28 in the base plate 12 may be readily accurately located relative to one another to obtain and hold a perfect fit between the worm gear and the worm.

On the opposite sides of the U-shaped bends 40, 40 from the flat portion 26, the base plate 12 includes another flat portion 62 located in the same plane as the portion 26. In use, the flat portions 26 and 62 are engageable with and attached to a flat supporting surface on a portion 64 of an instrument with which the machine head is used, as shown in FIG. 4. The instrument part 64 includes an opening through which the string post 14 passes and may also include a metal bushing 66 fixed thereto to add additional support to the string post.

FIG. 8 shows a machine head embodying this invention and adapted for use with three strings of a musical instrument. This device includes a single base plate 64 having three pairs of inverted U-shaped bends 67, 67 to each of which pairs is journalled a worm shaft 68. Each of the worm shafts 68, 68 is essentially similar to the worm shaft 16 of FIGS. 1 to 7 and the machine head 63 except for having a single base plate 64 otherwise incorporates the parts of three separate machine heads such as the one shown at 10 in FIGS. 1 to 7.

I claim:

1. A stringed instrument machine head comprising: a base plate having a flat horizontal portion with a circular opening passing therethrough, said base plate also having two inverted U-shaped bends spaced from one another along a common horizontal axis, a vertical string post journalled in said circular opening and having an upwardly facing shoulder engaging the bottom of said base plate, a worm gear fixed to said string post above said base plate, a horizontal worm shaft journalled in said U-shaped bends and having a worm between said bends which meshes with said worm gear, and a leaf spring having one portion located between said worm gear and said base plate and another portion engaging the bottom of said worm, said leaf spring having such an undeflected shape as to be held in a deflected state between said base member and said worm and worm gear so as to resiliently urge both said string post and said worm shaft upwardly relative to said base plate to seat said upwardly facing shoulder of said string post against said base member and to seat said worm shaft against said U-shaped bends.

2. A stringed instrument machine head as defined in claim 1 further characterized by said first portion of said leaf spring having an opening through which said string post passes.

3. A stringed instrument machine head comprising: a base member with a first opening passing vertically therethrough, a vertical string post journalled in and passing through said first opening of said base member for rotation relative thereto about a vertical axis, said string post having a lower portion extending downwardly from said base member and adapted to have a musical string attached thereto and wound thereon, said string post also having an upper portion extending upwardly from said base member and an upwardly facing radial shoulder adjacent the bottom surface of said base member, a worm gear fixed to said upper portion of said string post, a horizontal worm shaft with an axially extending worm, said worm shaft also having two axially extending bearing portions defining cylindrical bearing surfaces on opposite sides of said worm and a thumb turn at one end thereof, means on said base member defining two spaced downwardly facing inverted U-shaped bearing surfaces which respectively receive said two bearing portions of said worm shaft and rotatably support said worm in meshing relationship with said worm gear, and a leaf spring, said leaf spring having a first portion through which said post passes located between said base member and said worm gear and a second portion engaging the bottom of said worm, said leaf spring being of such undeflected shape as to be held in a deflected state between said base member and said worm and worm gear so as to resiliently urge both said string post and said worm shaft upwardly relative to said base member to seat said upwardly facing shoulder of said string post against said base member and to seat said bearing surfaces of said worm shaft against the bights of said downwardly facing inverted U-shaped bearing surfaces of said base member.

4. A stringed instrument machine head as defined in claim 3 further characterized by said base member consisting of a plate of sheet metal, said plate having a first horizontal flat portion through which said string post passes and said plate also having two aligned inverted U-shaped bends projecting upwardly from said flat portion and defining respectively said two downwardly facing U-shaped bearing surfaces, said plate having a slot between said two U-shaped bends for receiving said worm of said worm shaft.

5. A stringed instrument machine head as defined in claim 4 further characterized by said plate including a second horizontal flat portion located on the opposite side of said two U-shaped bends from said first flat portion, said first and second flat portions being located in a common plane and being adapted for attachment of said plate to a flat supporting surface on an instrument with which the machine head is used.

6. A stringed instrument machine head as defined in claim 5 further characterized by said worm shaft at opposite ends of said worm having oppositely facing radial shoulders, and said two U-shaped bends of said plate having oppositely directed vertical end surfaces facing one another and engageable with the said shoulders of said worm shaft to restrain axial movement of said worm shaft relative to said base member.

7. A stringed instrument machine head as defined in claim 6 further characterized by said worm gear having a downwardly facing end surface, said string post having a second upwardly facing radial shoulder against which said downwardly facing end surface of said worm gear bears to limit the downward movement of said worm gear relative to said string post, the axial spacing between said two radial shoulders of said string post being no less than the combined thicknesses of said base plate and said leaf spring and no more than 0.005 inch greater than the combined thickness of said base plate and said leaf spring.

8. A stringed instrument machine head as defined in claim 3 further characterized by said base member including further pairs of upwardly extending U-shaped bends and with each pair of U-shaped bends having another string post, worm shaft and leaf spring associated therewith similar to the ones aforesaid to provide a unit for use with a multiple number of strings.

* * * * *